US007810532B2

(12) United States Patent
Bird

(10) Patent No.: US 7,810,532 B2
(45) Date of Patent: Oct. 12, 2010

(54) ROUTER BIT SYSTEM AND METHOD FOR CONSTRUCTING TAMBOURS

(75) Inventor: Lonnie Bird, Dandridge, TN (US)

(73) Assignee: Amana Tool Corporation, Farmingdale, NY (US)

( * ) Notice: Subject to any disclaimer, the term of this patent is extended or adjusted under 35 U.S.C. 154(b) by 432 days.

(21) Appl. No.: 11/693,319

(22) Filed: Mar. 29, 2007

(65) Prior Publication Data

US 2008/0236705 A1 Oct. 2, 2008

(51) Int. Cl.
*B27C 1/00* (2006.01)
*B27F 1/00* (2006.01)

(52) U.S. Cl. ..... 144/241; 144/354; 407/62

(58) Field of Classification Search ..... 144/354, 144/135.2, 241, 371, 218, 136.95, 359, 360; 409/132, 31; 407/42, 53, 54, 61, 62, 56
See application file for complete search history.

(56) References Cited

U.S. PATENT DOCUMENTS 4,593,734 A * 6/1986 Wallace ..... 144/136.9
4,844,135 A * 7/1989 Witt ..... 144/371
4,993,465 A * 2/1991 Cotton et al. ..... 144/371
5,083,563 A * 1/1992 Collins ..... 607/4
5,217,289 A * 6/1993 Woodward et al. ..... 312/297
5,433,563 A * 7/1995 Velepec ..... 409/234
5,468,100 A * 11/1995 Naim ..... 409/234
5,662,435 A * 9/1997 Sherman ..... 407/31
5,996,659 A * 12/1999 Burgess ..... 144/347
6,021,615 A * 2/2000 Brown ..... 52/392
6,048,142 A * 4/2000 Hashimoto et al. ..... 29/888.022
6,216,410 B1 * 4/2001 Haberman ..... 52/591.1
6,817,813 B2 * 11/2004 Dollar et al. ..... 408/240
7,036,539 B2 * 5/2006 Sherman et al. ..... 144/241
7,131,473 B1 * 11/2006 Brewer ..... 144/371
2004/0206462 A1 * 10/2004 Fitzgerald et al. ..... 160/231.1

OTHER PUBLICATIONS

Rockler, Tambour Router Bit Set, 2003.*
Woodcraft, "Instructions for Train Track Bits", Apr. 28, 1997.*
Kenneth Baumert, "Building a Roll-Top Desk", Fine Woodworking, Dec. 1989, pp. 48-53, The Taunton Press, Newton, Connecticut.
Barry, Joe "Articulating Tambours". The Guild of New Hampshire Woodworkers, pp. 6-7, Nov. 2008.

* cited by examiner

*Primary Examiner*—Dana Ross
*Assistant Examiner*—Jennifer Chiang
(74) *Attorney, Agent, or Firm*—Dorsey & Whitney LLP

(57) ABSTRACT

A method for constructing tambour slats using a system of router bits. The router bit system can include at least two router bits, one of which may have a semi-spherical nose cutting surface and a concave 'S' shaped ogee cutting surface; and the other of which may have a 'S' shaped ogee cutting surface and a concave quarter round cutting surface. The method for constructing a tambour slat can include milling a groove in a strip of material. The strip of material with a groove may then be milled to form a tongue and a neck portion that may slide into a groove milled in another strip of material. The milling operations may be performed by a router fitted with the router bits from the router bit system. By using the router bit system, each strip of material may yield up to two tambour slats.

6 Claims, 5 Drawing Sheets

FIG. 6
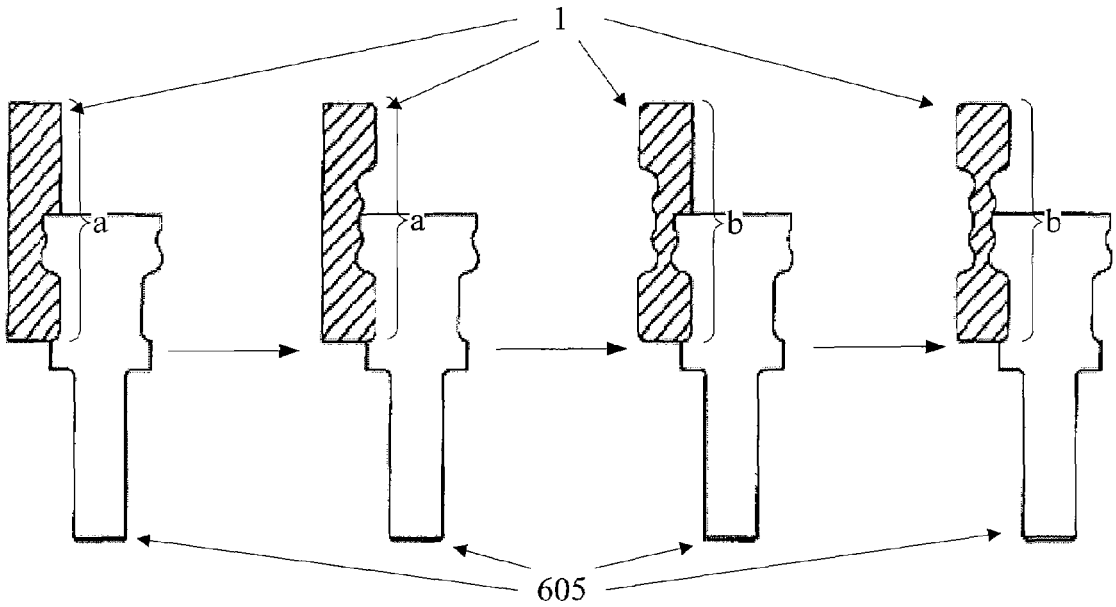
FIG. 6A FIG. 6B FIG. 6C FIG. 6D
FIG. 7
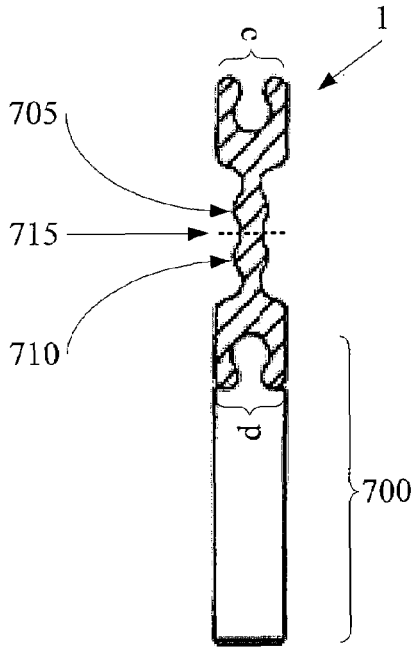

FIG. 9
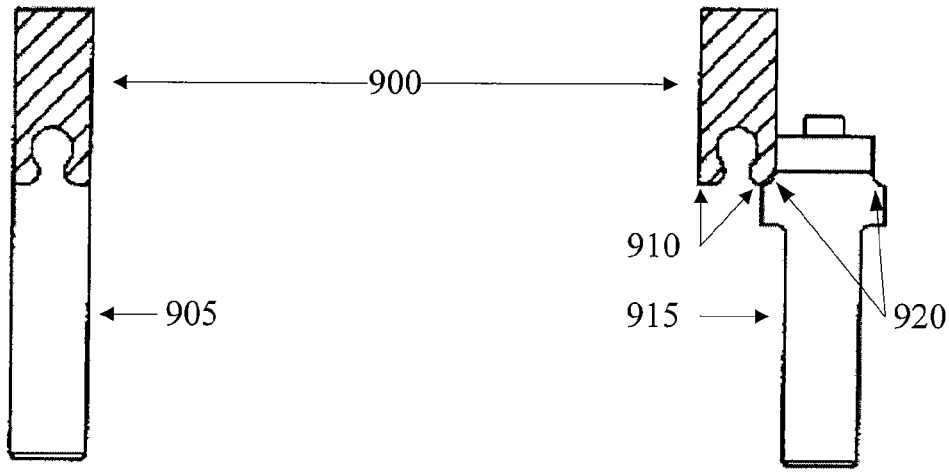
FIG. 9A
FIG. 9B
FIG. 10
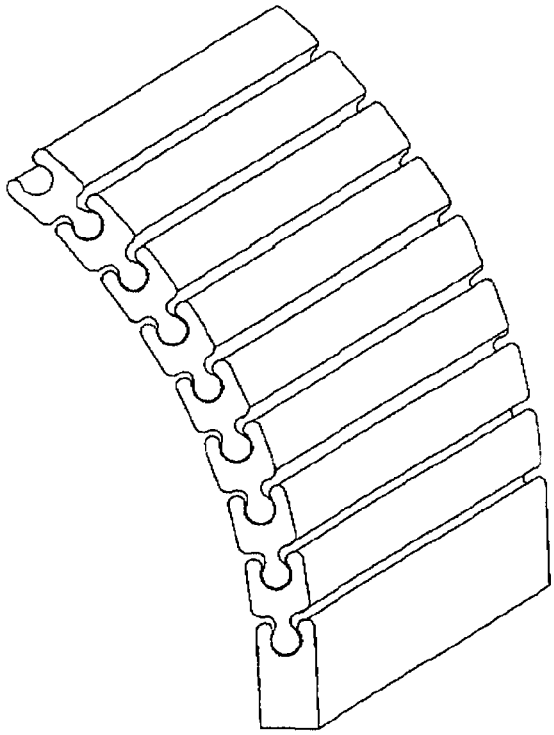

ROUTER BIT SYSTEM AND METHOD FOR CONSTRUCTING TAMBOURS

BACKGROUND OF THE INVENTION

Tambours are sliding flexible lids or covers, which secure the contents inside an enclosure while providing an aesthetically pleasing form. One of the most well-known tambours is the tambour used in a roll-top or tambour desk. The user of the desk can draw the tambour curtain over the working area of the desk to secure the contents on the desk, leaving a visually pleasing piece of furniture. Before the advent of the tambour, roll-top desks included a round cylindrical shell that would retract in tracks carved in the desk until the cylinder was hidden in the back of the desk. The use of tambours works in a very similar way, featuring horizontal slats in place of the solid cylinder. Although there are many varieties of the basic tambour design, the most common method for construction features slats glued to canvas. This type of tambour has the functional benefit of flexibility; however, it is difficult to assemble.

Currently, in addition to the canvas/slat design, it is known that tambours can be formed by using tongue and groove joints in the slats, thereby eliminating the need for canvas to bind the slats together, as described in an article entitled "Building a Roll-Top Desk: Interlocking slats form an all-wood tambour," by Kenneth Baument, published in the 1989 issue of "Fine Woodworking." While the Baument article describes a method which achieves a tongue and groove tambour with increased security and an aesthetically pleasing design, forming the joints using the method described in the Baument article is complex, requiring numerous cuts made with various router bits and flutes. It would be beneficial to obtain the attributes of the tongue and groove tambour with a simpler method of formation that would reduce construction time while facilitating the production of a more easily fabricated tongue and groove tambour.

SUMMARY OF THE INVENTION

A system of router bits for constructing tambour slats includes a first router bit, which has a cutting portion having a concave 'S' shaped ogee and a convex semi-spherical nose portion with a first curvature radius, and a second router bit, which has a first cutting profile having a 'S' shaped ogee with at least one curvature radius comparable to the first curvature radius and a second cutting profile, separated from the first cutting profile, having a concave quarter round.

A method for constructing at least one tambour slat from a strip of material, such as wood, includes milling a groove in at least one end of the strip of material and milling at least one tongue and neck portion. The first tongue and neck portion may be milled by milling a first 'S' shaped profile in a first surface of the strip of material in a first cutting operation and then milling a second 'S' shaped profile in a second surface of the strip of material, opposite the first surface, in a second cutting operation. A second tongue and neck portion may be milled by milling a third 'S' shaped profile in the first surface of the strip of material in a third cutting operation and then milling the fourth 'S' shaped profile in the second surface of the strip of material in a fourth cutting operation.

BRIEF DESCRIPTION OF THE DRAWINGS

FIG. 6A is an illustration depicting a first cut in milling the tongue and neck of the tambour slat;

FIG. 6B is an illustration depicting a second cut in milling the tongue and neck of the tambour slat;

FIG. 6C is an illustration depicting a third cut in milling the tongue and neck of the tambour slat;

FIG. 6D is an illustration depicting a fourth cut in milling the tongue and neck of the tambour slat;

FIG. 7 is an illustration depicting a cut in milling the semi-spherical groove of the tambour slat;

FIG. 9A is an illustration depicting a cut in milling the semi-spherical groove of the tambour slat end;

FIG. 9B is an illustration depicting a quarter round cut in milling the rounded edge of the tambour slat end;

FIG. 10 is an illustration of an exemplary embodiment of a series of connected tambour slats with a tambour slat end.

DETAILED DESCRIPTION OF THE PREFERRED EMBODIMENTS

Figure 1:
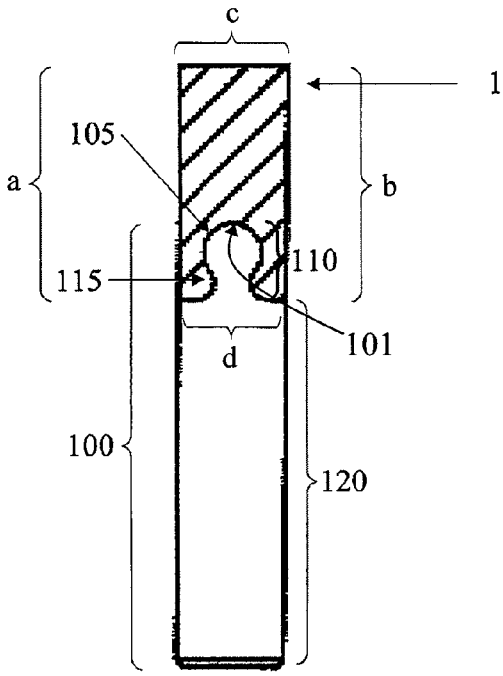
FIG. 1 is a cross-sectional illustration of an exemplary embodiment of Bit 1 in the present system of bits for constructing tambour slats.
Figure 2:
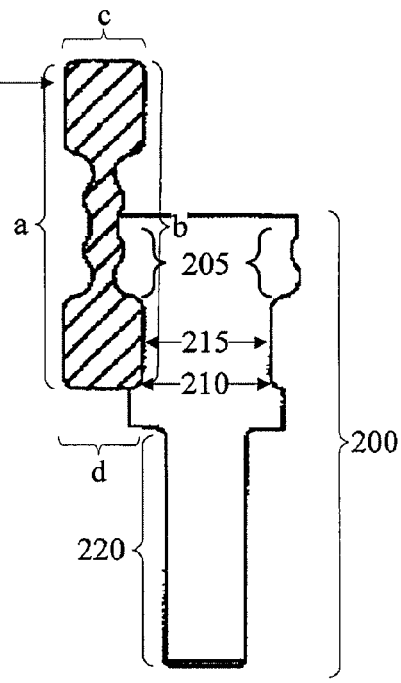
FIG. 2 is an cross-sectional illustration of an exemplary embodiment of Bit 2 in the present system of bits for constructing tambour slats.

An overview of the present system of router bits used to create a tambour is represented by reference to the illustrations in FIGS. 1 and 2. FIG. 1 is a cross-sectional view of Bit 1 100, which is used to mill a groove 101 in the end of a strip 1, having a first face a, a second face b, a first end c, and a second end d. Bit 1 100 is generally formed with a convex semi-spherical round nose 105, an 'S' shaped ogee 110 to form a tapered neck 115, and a collet shaft 120 capable of fitting in a collet of a conventional router. FIG. 2 is a cross-sectional view of Bit 2 200, which is formed such that when the two faces a, b of the strip 1 are milled with Bit 2 200, an elongated tongue, compatible with the curvature of the groove 101 formed by Bit 1 100, may be formed. In this regard, Bit 2 200 should contain a 'S' shaped ogee 205, a concave quarter round curve 210, a shaft 215-220 that may either have a cutting surface or be slightly removed from the workpiece, and a collet shaft 220 capable of fitting in a collet of a conventional router. Preferably, the ogee 205 has a curvature that will allow the resulting tongue to fit into the groove 101 created by the round nose 105 and be free to rotate therein. The router bits 100, 200 may be formed as known in the art, with the cutting surfaces preferably made of high speed steel, carbide, or an equivalent material used in the art.

Figure 3:
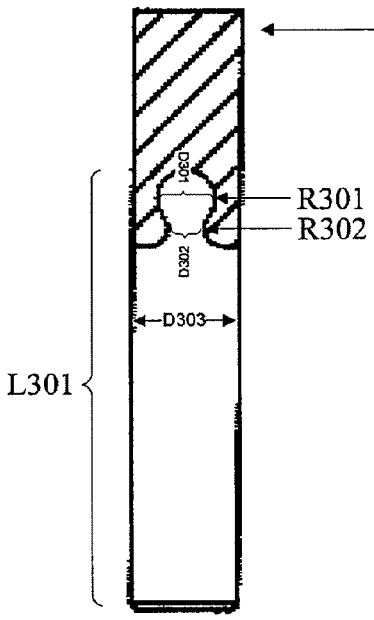
FIG. 3 is a cross-sectional illustration of an exemplary embodiment of Bit 1 in the present system of bits for constructing tambour slats.
Figure 4:
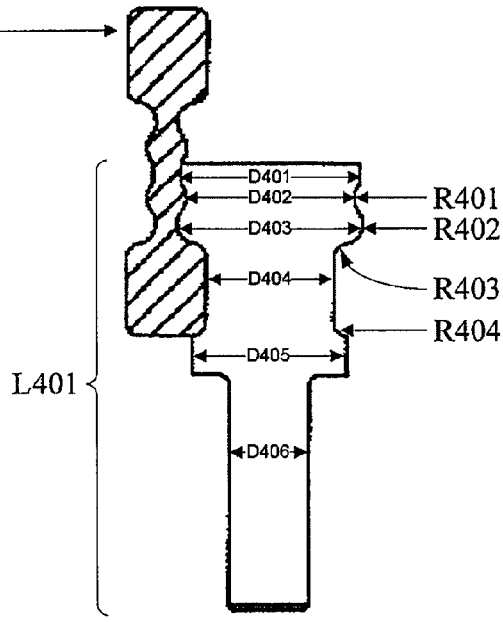
FIG. 4 is an cross-sectional illustration of an exemplary embodiment of Bit 2 in the present system of bits for constructing tambour slats.

Referring to FIG. 3, in an exemplary embodiment of the present system of bits, Bit 1 has a length of about 3" L301, a round nose diameter of 17/64" D301, a neck diameter of ⅛" D302, a shaft diameter of ½" D303, a nose radius of curvature of 17/128" R301, a neck radius of curvature of 11/128" R302. Referring to FIG. 4, in an exemplary embodiment of the present system of bits, Bit 2 has a length of 2¾"; a first 'S' shaped ogee diameter of 1.142" D401, a second 'S' shaped ogee diameter of 1.055" D402, a third 'S' shaped ogee diameter of 1.170" D403, a diameter of 0.762" D404 for shaft connecting the quarter round and the 'S' shaped ogee, a diameter of 1.165" D405 for the shaft connecting the quarter round to the collet shaft, and a collet shaft diameter of 0.499" D406; a 'S' shaped ogee with radiuses of curvature of 0.125" R401, 0.125" R402, and 0.086" R403; and a quarter round radius of curvature of 0.086" R404. The values provided are merely exemplary. It will be appreciated that numerous variants on these dimensions will arrive at a suitable tambour so long as the radiuses of curvature for Bit 1 substantially correspond to the radiuses of curvature for the 'S' shaped ogee of Bit 2 in a such a way as to create a flexible tongue a groove joint.

Figure 5:
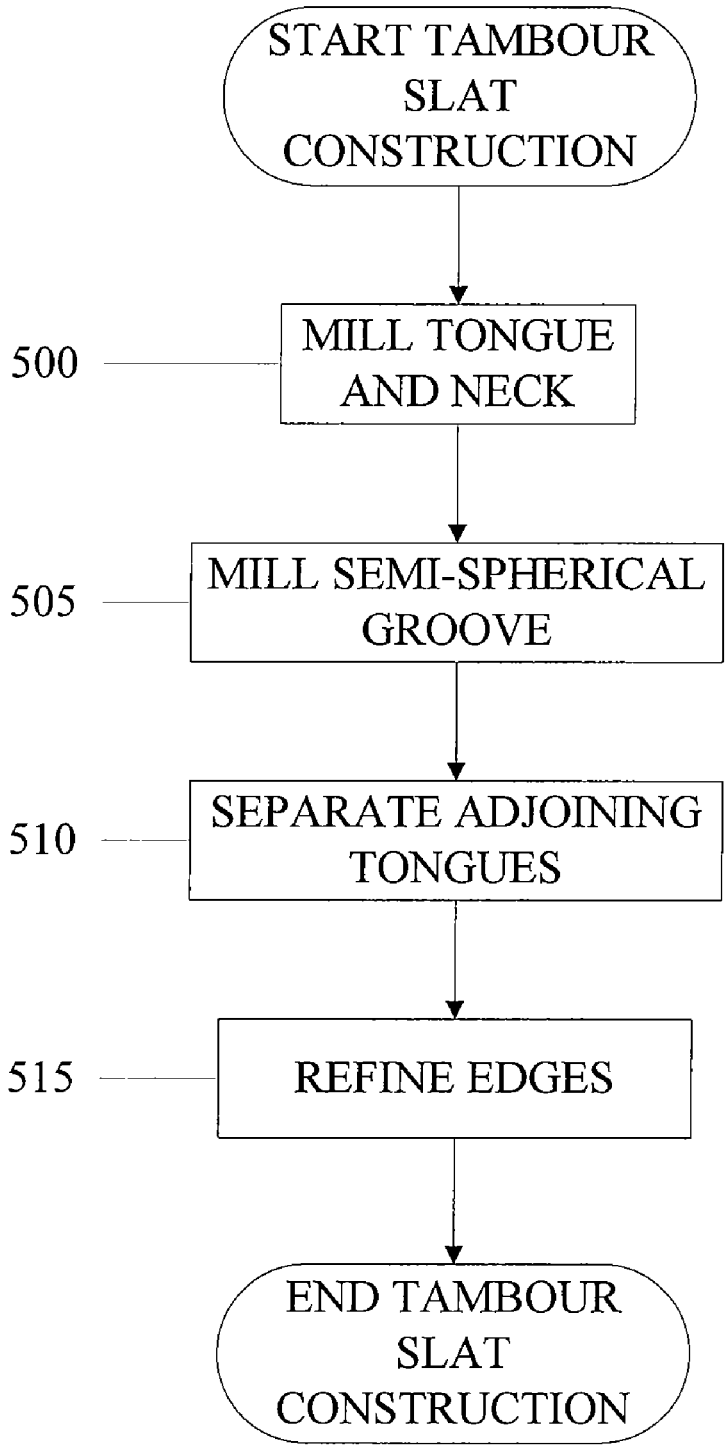
FIG. 5 is a simplified flow chart illustrating the various steps in one exemplary embodiment of the present method for constructing tambour slats.

An overview of the present method for constructing tambour slats is illustrated by reference to the simplified flow chart in FIG. 5. In the exemplary embodiment of the present method, each strip 1 may form up to two tambour slats. The width of the strip 1 may be slightly larger than twice the width of the desired tambour slat so that the strip may yield two tambour slats of equal size. For the exemplary dimensions of Bit 2, described above, a tambour slat of width ½" is formed from a strip with a width of at least 2⁵⁄₃₂". The process for forming two tambour slats from a strip 1 generally can be accomplished in four steps 500, 505, 510, and 515. In step 500, a tongue and neck may be milled by using Bit 2. Further illustrated by FIGS. 6A through 6D, a strip 1 is preferably subject to four cuts that may be executed by Bit 2 305. Although these cuts may be completed in any order, FIG. 6A represents what may be the first cut on a first face a of strip 1, FIG. 6B represents what may be the second cut on the first face a of strip 1 (overall second cut on strip 1), FIG. 6C represents what may be the first cut on the opposing face b of strip 1 (overall third cut on strip 1), and FIG. 6D represents what may be the second cut on the opposing face b of strip 1 (overall forth cut on strip 1).

Figure 8:
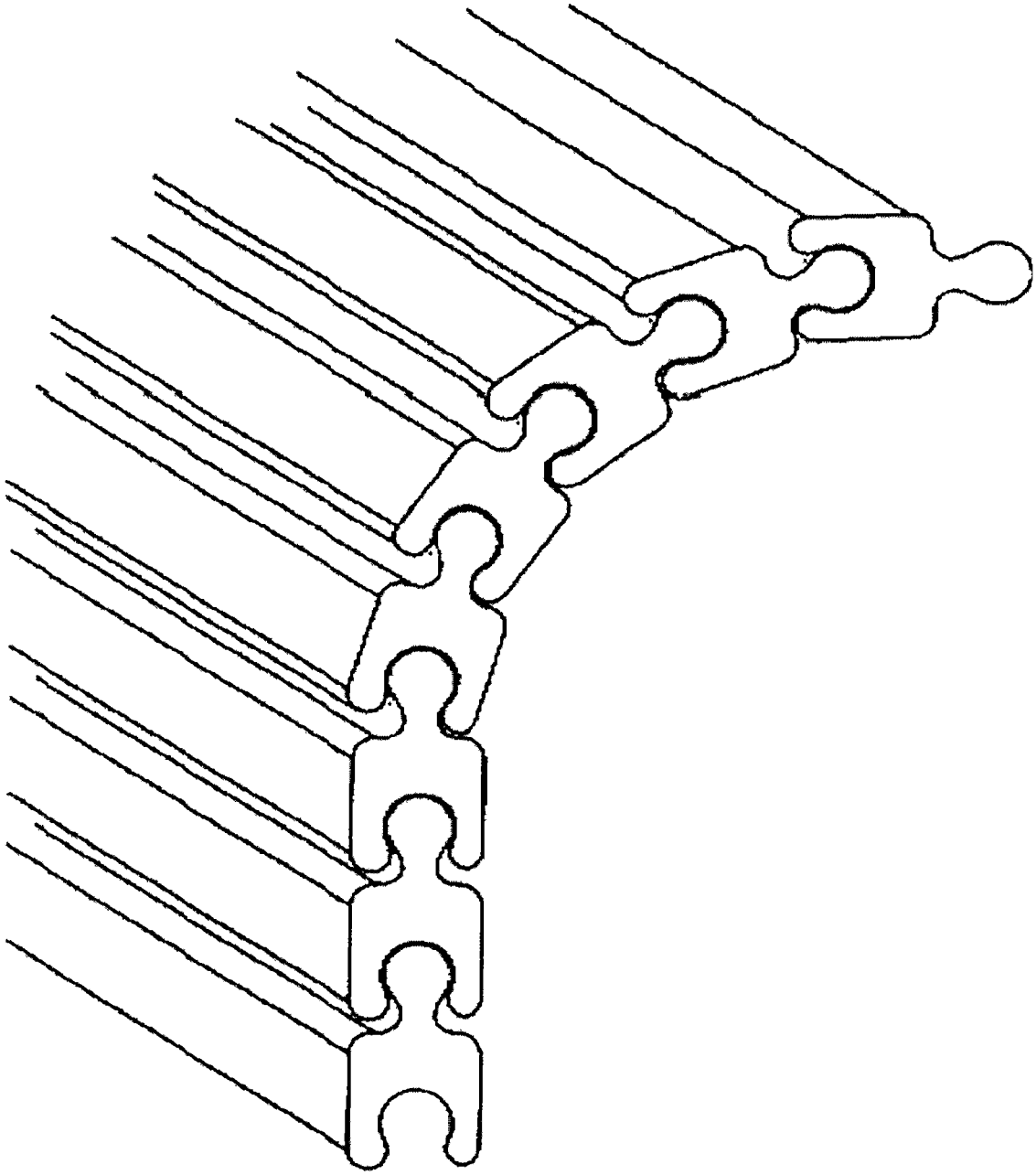
FIG. 8 is an illustration of an exemplary embodiment of a series of connected tambour slats.

In step 505, a groove may be milled in at least one end of strip 1 by using Bit 1. Preferably, as illustrated in FIG. 7, the strip 1 may be subject to two cuts, one on each end c, d, that may be executed by Bit 1 700 to form two grooves through which a tambour slat tongue may slide. The one milling operation of step 505 are illustrated as following step 500, however the order of these two steps is not critical and may be reversed. In step 510, the adjoining tongue portions 705, 710 created in step 505 may be separated, such as by cutting strip 1 along the dotted line 715 with a band saw. To further finish the tongue portion, a sanding step may also be used to relieve any remaining edges after the cutting operations. In step 515, the edges may be refined as known in the art so that the tambour joint glides more freely. The curvature of the tongue should be maintained such that the resulting slat may glide smoothly into the groove of another slat created by the cut made by Bit 1 in step 500, thereby creating a flexible joint. After a number of tambour slats are formed, the slats may be assembled to form a tambour by sliding the tongue and neck portion of one slat into the groove portion of a second slat, as illustrated in an exemplary embodiment in FIG. 8.

While the above process is desirable for forming two tambour slats per strip, it may be appreciated that Bits 1 and 2 may be used to form only a single slat per strip. In that case, the strip would be approximately the width of the desired tambour slat. Step 500 in FIG. 5 would involve two cuts with Bit 2, one on a first face and the other on the opposing face of the strip. Step 505 would involve only one end cut with Bit 1 and step 510 would not be necessary.

In addition it may be desirable to create a tambour end slat to attach to the tongue end of the tambour represented in an exemplary embodiment in FIGS. 9 and 10. To form a finished tambour, one may wish to mill an end piece with a semi-spherical groove, through which a tongue of another tambour slat may slide to form a finished end. A similar strip to that which is used in the tambour slat construction may be used in the process illustrated by FIGS. 9A and 9B. Referring to FIG. 9A, a strip 900 may be milled with Bit 1 905. The strip's faces 910 are preferably milled by a concave quarter round 915, which has a quarter round convex cutting profile 920, to create curved edges similar to those created by the quarter round of Bit 2 in step 500 of FIG. 5. The curvature radiuses for the quarter round in 915 and the quarter round in Bit 2 should be similar if not the same. Referring to FIG. 10, the finished tambour end slat may slide onto the tambour illustrated in FIG. 8 to create a finished end with a flexible joint.

What is claimed is:

1. A system of router bits for constructing tambour slats, comprising:

a first router bit, said first router bit having a cutting portion including a concave 'S' shaped ogee and a convex semi-spherical nose portion with a first curvature radius proximate to a distal end of said first router bit; and a second router bit having a first cutting profile proximate to a distal end of said second router bit with a concave 'S' shaped ogee with at least one curvature radius comparable to the first curvature radius and a second cutting profile, separated from the first cutting profile by a substantially straight surface, the second cutting profile having a concave quarter round, the first cutting profile and second cutting profile being sized and shaped such that when the second router bit is applied to opposing surfaces of a strip of material a tongue and neck portion is formed that can be rotatably engaged and retained in a groove formed by the first router bit in at least one edge surface of said strip of material.

2. A method for constructing at least one tambour slat from a strip of material having a first surface, an opposing surface and first and second edge surfaces defining a thickness of the strip between said first surface and said opposing surface, comprising:

milling a groove with a first router bit in at least one edge surface of the strip of material, said first router bit having a cutting portion including a concave 'S' shaped ogee and a convex semi-spherical nose portion with a first curvature radius proximate to a distal end of said first router bit; and milling a first tongue and neck portion that is sized and shaped to be rotatably engaged and retained in a groove formed by the first router bit by:

milling a first 'S' shaped profile with a second router bit in the first surface of the strip of material in a single cutting operation, said second router bit having a first cutting profile proximate to a distal end of said second router bit with a concave 'S' shaped ogee with at least one curvature radius comparable to the first curvature radius and a second cutting profile, separated from the first cutting profile by a substantially straight surface, the second cutting profile having a concave quarter round contour; and milling a second 'S' shaped profile with said second router bit in the opposing surface of the strip of material in a single cutting operation.

3. The method of claim 2, wherein the material is wood.

4. The method of claim 2, further comprising milling a second tongue and neck portion by:

milling a third 'S' shaped profile in the first surface of the strip of material in a single cutting operation; and milling a fourth 'S' shaped profile in the opposing surface of the strip of material in a single cutting operation.

5. A method for constructing two tambour slats from a strip of material having a first surface, an opposing surface and first and second edge surfaces defining a thickness of the strip between said first surface and said opposing surface, comprising:

milling a first groove with a first router bit in the first edge surface of the strip of material, said first router bit having a cutting portion including a concave 'S' shaped ogee and a convex semi-spherical nose portion with a first curvature radius proximate to a distal end of said first router bit;

milling a second groove with said first router bit in the second edge surface of the strip of material;

milling a first tongue and neck portion that is sized and shaped to be rotatably engaged and retained in a groove formed by the first router bit by:

milling a first 'S' shaped profile with a second router bit in the first surface of the strip of material in a single cutting operation, said second router bit having a first cutting profile proximate to a distal end of said second router bit with a concave 'S' shaped ogee with at least one curvature radius comparable to the first curvature radius and a second cutting profile, separated from the first cutting profile by a substantially straight surface, the second cutting profile having a concave quarter round contour;

milling a second 'S' shaped profile with said second router bit in an opposing surface of the strip of material in a single cutting operation;

milling a second tongue and neck portion that is sized and shaped to be rotatably engaged and retained in a groove formed by the first router bit by:

milling a third 'S' shaped profile in the first surface of the strip of material in a single cutting operation; and milling a fourth 'S' shaped profile in the opposing surface of the strip of material in a single cutting operation; and cutting the strip of material proximate to the first tongue and second tongue, thereby forming two tambour slats.

6. The method of claim 4, further comprising cutting the strip of material proximate to the first tongue and second tongue, thereby forming two tambour slats.

* * * * *